US010677252B2

(12) United States Patent
Chou et al.

(10) Patent No.: US 10,677,252 B2
(45) Date of Patent: Jun. 9, 2020

(54) FAN STRUCTURE

(71) Applicant: ASIA VITA COMPONENTS CO., LTD., New Taipei (TW)

(72) Inventors: Shih-Cheng Chou, New Taipei (TW); Chang-Yen Ho, New Taipei (TW); Chung-Chien Su, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 216 days.

(21) Appl. No.: 15/821,723

(22) Filed: Nov. 22, 2017

(65) Prior Publication Data

US 2019/0154250 A1 May 23, 2019

(51) Int. Cl.

| | |
|---|---|
| ***F04D 29/00*** | (2006.01) |
| ***F04D 29/056*** | (2006.01) |
| ***F04D 25/06*** | (2006.01) |
| ***F04D 29/32*** | (2006.01) |
| ***F04D 29/053*** | (2006.01) |
| ***F04D 19/00*** | (2006.01) |

(52) U.S. Cl.

CPC ..... *F04D 29/005* (2013.01); *F04D 25/0613* (2013.01); *F04D 29/056* (2013.01); *F04D 19/002* (2013.01); *F04D 29/053* (2013.01); *F04D 29/325* (2013.01)

(58) Field of Classification Search

CPC .. F21V 33/0096; F04D 29/056; F04D 29/053; F04D 29/325; F04D 29/005; F04D 25/088; F04D 25/06; F04D 25/0613; F04D 19/002; F04D 29/522; F04D 25/062

See application file for complete search history.

(56) References Cited

U.S. PATENT DOCUMENTS

| | | | | |
|---|---|---|---|---|
| 6,679,771 | B2 * | 1/2004 | Lee | H05K 7/20209 237/46 |
| 6,790,003 | B1 * | 9/2004 | Hu | F04D 25/0613 415/118 |
| 7,037,073 | B2 * | 5/2006 | Lin | F04D 25/0613 362/500 |
| 7,121,697 | B2 * | 10/2006 | Hsu | H05K 7/20172 362/386 |

(Continued)

FOREIGN PATENT DOCUMENTS

JP 11324985 A * 11/1999

*Primary Examiner* — Nathan C Zollinger
(74) *Attorney, Agent, or Firm* — Jackson IPG PLLC; Demian K. Jackson

(57) ABSTRACT

A fan structure includes a fan impeller, a fan seat and a hollow shaft rod. The fan impeller has a circumferential section and a top section. The circumferential section has multiple fan blades. The fan seat has a bearing cup. A light-emitting unit and a photoconductive component are received in the bearing cup. The hollow shaft rod has a first end, a second end and a through hole. The through hole axially passes through the hollow shaft rod between the first and second ends. A first end of the hollow shaft rod is inserted in the top section of the fan impeller. A second end of the hollow shaft rod is inserted in the bearing cup of the fan seat and assembled with the photoconductive component. The fan structure improves the shortcoming of the conventional light-emitting fan that the light can be hardly fully projected.

10 Claims, 4 Drawing Sheets

(56) References Cited

U.S. PATENT DOCUMENTS

| | | | | |
|---|---|---|---|---|
| 7,332,841 | B2 * | 2/2008 | Hsu | H02K 7/14 310/261.1 |
| 7,563,070 | B2 * | 7/2009 | Lin | F04D 29/005 310/73 |
| 10,082,286 | B1 * | 9/2018 | Huang | F04D 25/0613 |
| 10,101,020 | B2 * | 10/2018 | Hung | F04D 29/703 |
| 2003/0231956 | A1 * | 12/2003 | Lin | F04D 29/582 415/118 |
| 2004/0257774 | A1 * | 12/2004 | Lin | F04D 29/38 361/719 |
| 2018/0017725 | A1 * | 1/2018 | Fang | F21V 33/0096 |
| 2018/0163960 | A1 * | 6/2018 | Lin | H05B 33/0857 |
| 2018/0187689 | A1 * | 7/2018 | Chen | F04D 27/004 |
| 2019/0085855 | A1 * | 3/2019 | Horng | F04D 29/005 |

* cited by examiner

FAN STRUCTURE

BACKGROUND OF THE INVENTION

1. Field of the Invention

The present invention relates generally to a fan structure, and more particularly to a fan structure with light-emitting effect.

2. Description of the Related Art

A fan mainly serves as an active heat dissipation device for forcedly dissipating heat. The fan is generally disposed on a heat source to directly forcedly carry away the heat of the heat source. Alternatively, the fan is applied to a space for guiding and circulating airflow. In accordance with the demand of the current market, in addition to forced heat dissipation and airflow circulation, some manufacturers have developed a light-emitting fan in which light-emitting units are disposed on the fan blades. When the fan operates, the light-emitting units will emit light to form a character. Alternatively, LED strips are added to outer circumference of the fan impeller to achieve light-emitting effect. However, the addition of the light-emitting units onto the fan blades or the fan impeller will lead to balance problem in operation of the fan. Moreover, the fan impeller has a central shaft and the light-emitting units cannot be disposed at the central shaft so that the central shaft of the fan is unable to provide light-emitting effect.

SUMMARY OF THE INVENTION

It is therefore a primary object of the present invention to provide a fan structure, in which the central shaft of the fan impeller is equipped with a light-emitting unit to provide light-emitting effect.

To achieve the above and other objects, the fan structure of the present invention includes a fan impeller, a fan seat and a hollow shaft rod.

The fan impeller has a circumferential section and a top section. The circumferential section has multiple fan blades.

The fan seat has a bearing cup. A light-emitting unit and a photoconductive component are received in the bearing cup.

The hollow shaft rod has a first end, a second end and a through hole. The through hole axially passes through the hollow shaft rod between the first and second ends. A first end of the hollow shaft rod is inserted in the top section of the fan impeller. A second end of the hollow shaft rod is inserted in the bearing cup of the fan seat and assembled with the photoconductive component.

In the fan structure of the present invention, the hollow shaft rod is used instead of the conventional shaft rod and the light-emitting unit is disposed in the hollow shaft rod to emit and project light. Accordingly, the present invention solves the problem of the conventional light-emitting fan that the central shaft is unable to provide light-emitting effect.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
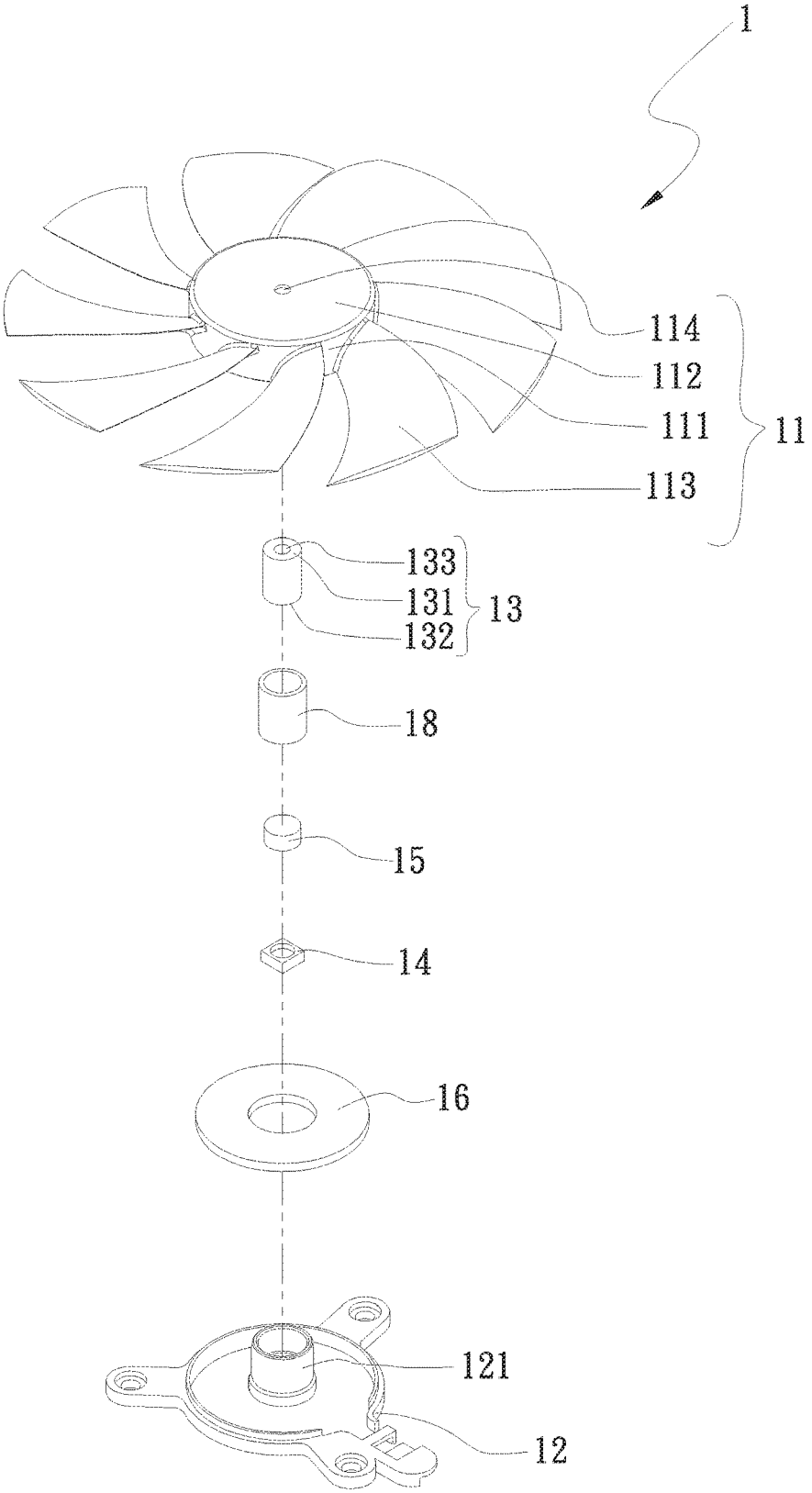
FIG. 1 is a perspective exploded view of a first embodiment of the fan structure of the present invention.
Figure 2:
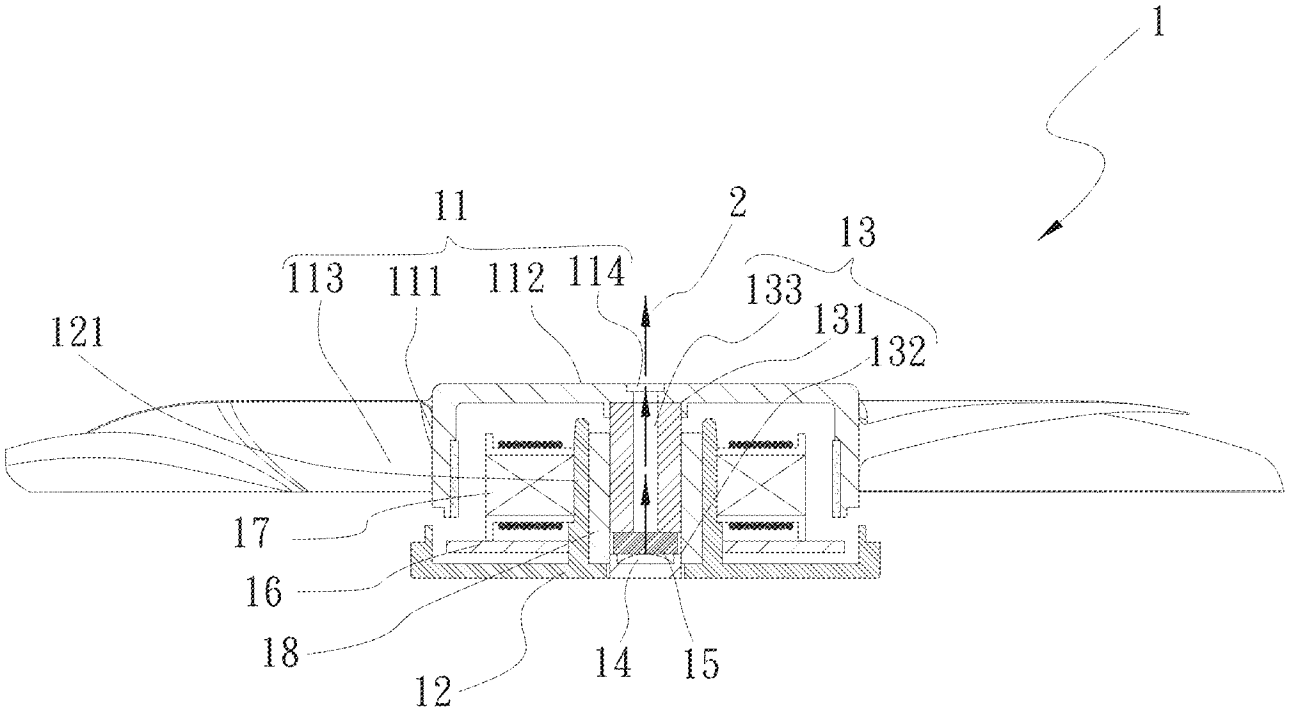
FIG. 2 is a sectional assembled view of the first embodiment of the fan structure of the present invention.

Please refer to FIGS. 1 and 2. FIG. 1 is a perspective exploded view of a first embodiment of the fan structure of the present invention. FIG. 2 is a sectional assembled view of the first embodiment of the fan structure of the present invention. According to the first embodiment, the fan structure 1 of the present invention includes a fan impeller 11, a fan seat 12 and a hollow shaft rod 13.

The fan impeller 11 has a circumferential section 111 and a top section 112. The circumferential section 111 has multiple fan blades 113. The circumferential section 111 is disposed along an outer periphery of the fan impeller 11 around the axis thereof. The top section 112 is radially disposed on the top of the circumferential section 111 of the fan impeller 11. The circumferential section 111 is connected with the top section 112. The fan blades 113 are annularly disposed on the circumferential section 111 of the fan impeller 11.

The fan seat 12 has a bearing cup 121. A light-emitting unit 14 and a photoconductive component 15 are received in the bearing cup 121. The bearing cup 121 is uprightly disposed at a center of the fan seat 12. The light-emitting unit 14 is disposed on the bottom of the bearing cup 121. The photoconductive component 15 is mated with the light-emitting unit 14. The light-emitting unit 14 is a bulb or a light-emitting diode LED.

The hollow shaft rod 13 has a first end 131, a second end 132 and a through hole 133. The through hole 133 axially passes through the hollow shaft rod 13 between the first and second ends 131, 132. The first end 131 of the hollow shaft rod 13 is inserted in the top section 112 of the fan impeller 11. The center of the top section 112 of the fan impeller 11 is formed with a perforation 114. The first end 131 of the hollow shaft rod 13 is correspondingly inserted at the perforation 114. The second end 132 of the hollow shaft rod 13 is inserted in the bearing cup 121 of the fan seat 12 and assembled with the photoconductive component 15.

When the light-emitting unit 14 emits light 2, the light 2 is projected through the photoconductive component 15 to the top section 112 of the fan impeller 11. The photoconductive component 15 is a lens. One face of the photoconductive component 15 is mated with the hollow shaft rod 13, while the other face of the photoconductive component 15 is mated with the light-emitting unit 14. The lens serves to converge the light 2 emitted by the light-emitting unit 14 and directly concentratively project the light 2 to the through hole 133 of the hollow shaft rod 13. Accordingly, the light 2 can be directly converged and projected to the perforation 114 at the center of the top section 112 of the fan impeller 11. Therefore, the light 2 can be projected out from the through hole 133 of the hollow shaft rod 13 without scattering.

Figure 3:
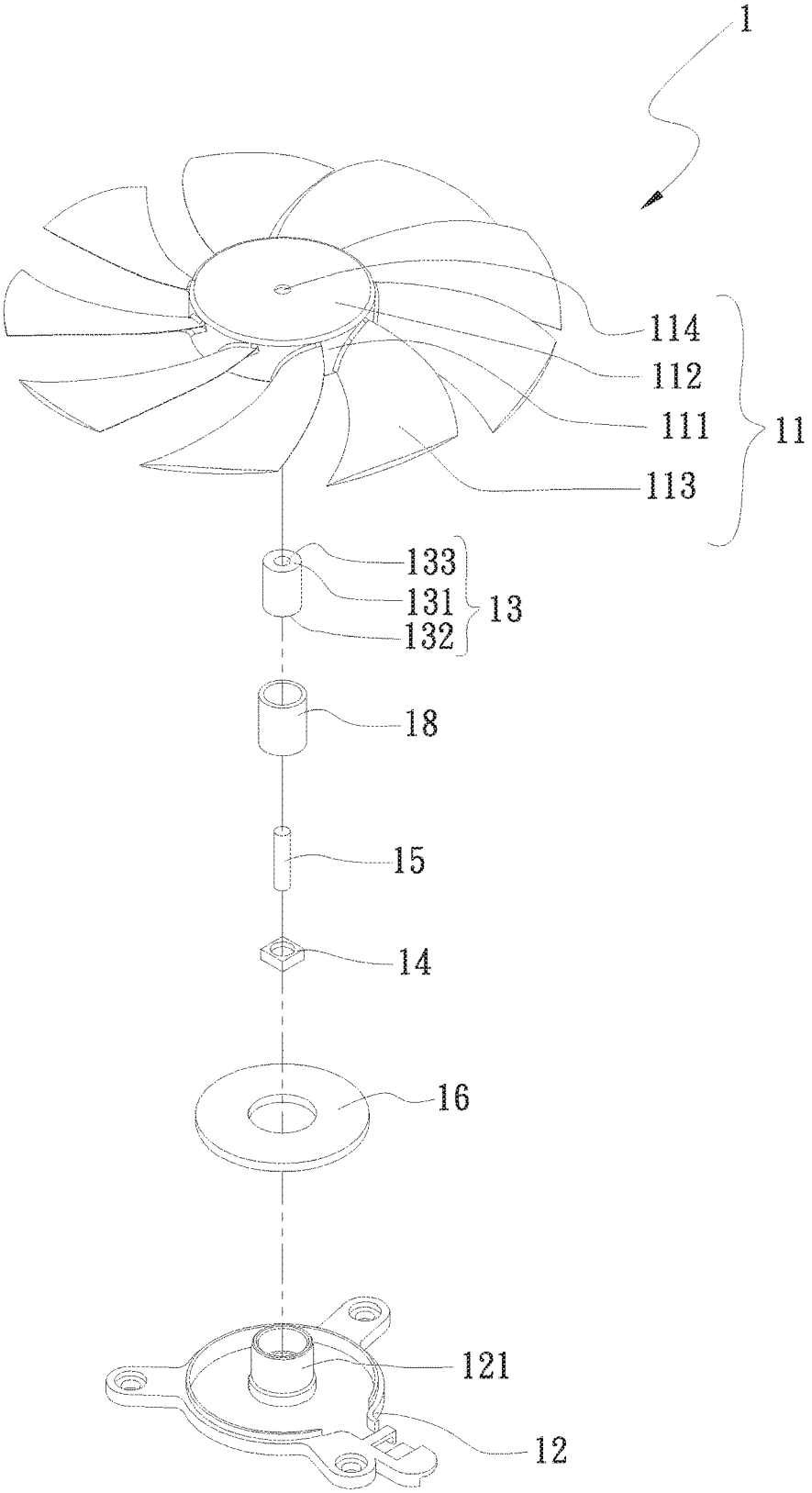
FIG. 3 is a perspective exploded view of a second embodiment of the fan structure of the present invention.
Figure 4:
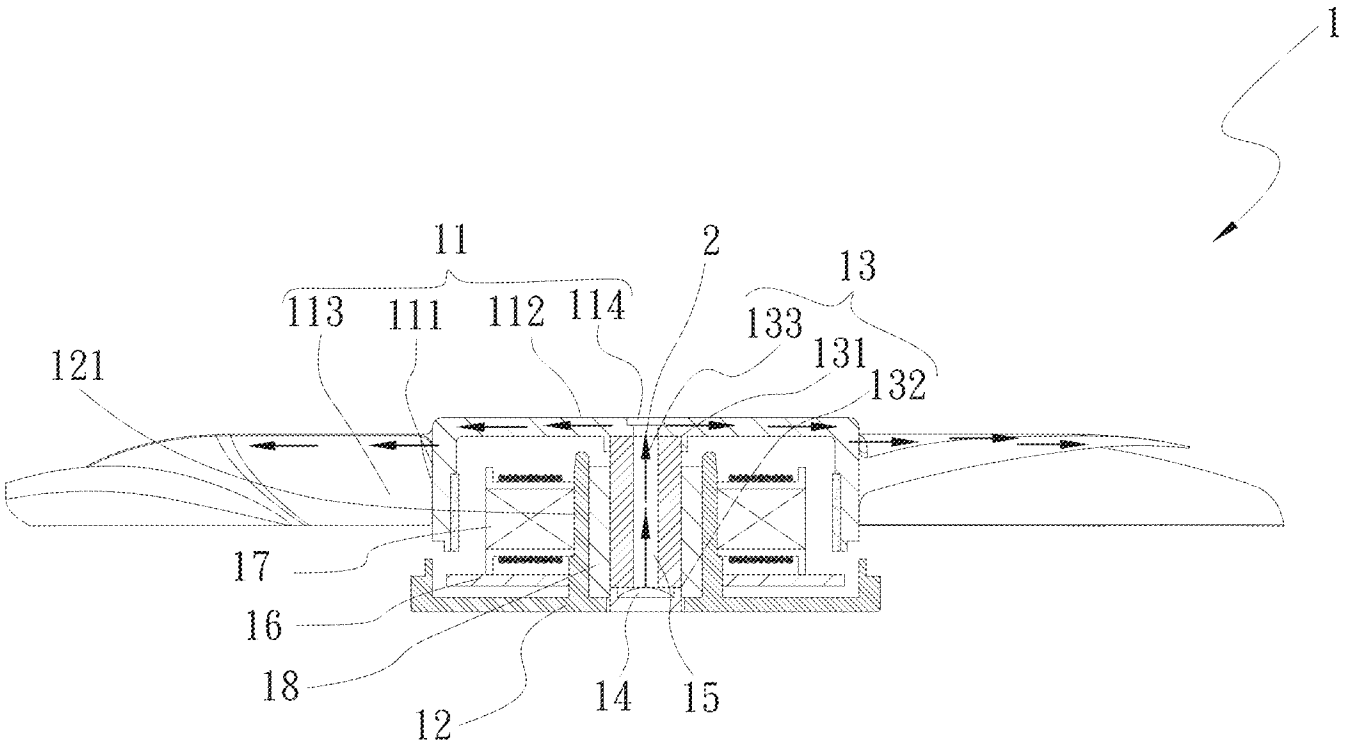
FIG. 4 is a sectional assembled view of the second embodiment of the fan structure of the present invention.

Please now refer to FIGS. 3 and 4. FIG. 3 is a perspective exploded view of a second embodiment of the fan structure of the present invention. FIG. 4 is a sectional assembled view of the second embodiment of the fan structure of the present invention. The second embodiment is partially identical to the first embodiment in structure and thus will not be redundantly described hereinafter. The second embodiment is different from the first embodiment in that the photoconductive component 15 is a photoconductive strip or a photoconductive rod. One end of the photoconductive component 15 is inserted in the through hole 133 of the hollow shaft rod 13 to extend to the first end 131 of the hollow shaft rod 13.

The light emitted from the light-emitting unit 14 is directly projected through the photoconductive component 15 to the top section 112 of the fan impeller 11. The fan impeller 11 is entirely made of a transparent material so that the light 2 is directly conducted by the photoconductive component 15 and projected to the top section 112 and the fan blades 113 of the fan impeller 11. This solves the balance problem and other shortcomings of the top section and the fan blades of the conventional fan impeller.

In the above first and second embodiments, the fan blades 113 can be selectively made of a transparent material to enhance the projection effect of the light 2.

A circuit motherboard 16 is disposed around the bearing cup 121 of the fan seat 12. A stator 17 is fitted around the bearing cup 121. The circuit motherboard 16 is electrically connected to the light-emitting unit 14 and the stator 17. The circuit motherboard 16 serves to control the fan and the light-emitting unit 14. A bearing 18 is disposed between the bearing cup 121 and the hollow shaft rod 13.

The present invention improves the shortcoming of the conventional fan with light-emitting effect that it is impossible to project light from the central shaft of the fan impeller. Moreover, the present invention employs a simple mechanism and unit to achieve light-emitting effect.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A fan structure comprising:

a fan impeller having a circumferential section and a top section, the circumferential section having multiple fan blades;

a fan seat having a bearing cup, a light-emitting unit and a photoconductive component being received in the bearing cup; and a hollow shaft rod having a first end, a second end and a through hole, the through hole axially passing through the hollow shaft rod between the first and second ends, a first end of the hollow shaft rod being inserted in the top section of the fan impeller, a second end of the hollow shaft rod being inserted in the bearing cup of the fan seat and assembled with the photoconductive component.

2. The fan structure as claimed in claim 1, wherein the photoconductive component is a lens or a photoconductive strip.

3. The fan structure as claimed in claim 1, wherein the light-emitting unit is a bulb or a light-emitting diode LED.

4. The fan structure as claimed in claim 1, wherein one end of the photoconductive component is inserted in the through hole of the hollow shaft rod.

5. The fan structure as claimed in claim 1, wherein one face of the photoconductive component is mated with the hollow shaft rod, while the other face of the photoconductive component is mated with the light-emitting unit.

6. The fan structure as claimed in claim 1, wherein the fan blades are made of a transparent material.

7. The fan structure as claimed in claim 1, wherein a circuit motherboard is disposed around the bearing cup of the fan seat.

8. The fan structure as claimed in claim 1, wherein a bearing is disposed in the bearing cup.

9. The fan structure as claimed in claim 7, wherein a stator is fitted around the bearing cup and electrically connected to the circuit motherboard.

10. The fan structure as claimed in claim 1, wherein a center of the top section of the fan impeller is formed with a perforation, the first end of the hollow shaft rod being correspondingly inserted at the perforation.

* * * * *